United States Patent [19]

Shiiki et al.

[11] 4,420,348

[45] Dec. 13, 1983

[54] AMORPHOUS ALLOY FOR MAGNETIC HEAD CORE

[75] Inventors: Kazuo Shiiki, Kanagawa; Shigekazu Otomo, Hachioji; Mitsuhiro Kudo, Hamuramachi; Mitsuo Abe, Yokohama, all of Japan

[73] Assignees: Hitachi, Ltd.; Hitachi Metals, Ltd.; Research Development Corporation of Japan, all of Tokyo, Japan

[21] Appl. No.: 248,456

[22] Filed: Mar. 27, 1981

[30] Foreign Application Priority Data

Mar. 28, 1980 [JP] Japan ..... 55/38888

[51] Int. Cl.[3] ..... C22C 33/00

[52] U.S. Cl. ..... 148/403; 148/31.55

[58] Field of Search ..... 148/31.55, 31.57, 403; 75/171

[56] References Cited

U.S. PATENT DOCUMENTS 4,052,201 10/1977 Polk et al. ..... 75/171
4,187,128 2/1980 Billings et al. ..... 148/31.55
4,231,816 11/1980 Cuomo et al. ..... 148/31.55

FOREIGN PATENT DOCUMENTS 54-146849 11/1979 Japan .

*Primary Examiner*—John P. Sheehan
*Attorney, Agent, or Firm*—Antonelli, Terry & Wands

[57] ABSTRACT

Amorphous alloy for magnetic head core represented by the general formula, $(Fe_xCo_{1-x})_a\ Cr_bSi_c\text{-}B_{1-a-b-c}$, where the value of x is 0.04–0.07, the value of a is 0.73–0.75, the value of b is 0.005–0.03, and the value of c is 0.02–0.06. The present amorphous alloy has high permeability, high saturation flux density, low magnetostriction, and low magnetic after-effect at the same time, and has distinguished characteristics for magnetic head core.

6 Claims, 12 Drawing Figures

AMORPHOUS ALLOY FOR MAGNETIC HEAD CORE

BACKGROUND OF THE INVENTION

This invention relates to an amorphous alloy for magnetic head core with high permeability, high saturation flux density and low magnetic after-effect.

The characteristics of a head for a high density magnetic recording and reproducing system require high sensitivity, low distortion and low noise in a broad frequency range, and good wear resistivity and a long life.

The so far known materials for magnetic head core include, for example, ferrite materials such as Mn-Zn ferrite, etc. and alloy materials such as sen-alloy, but the characteristics of these materials are not always satisfactory. That is, the ferrite materials have good high frequency characteristics and high wear resistivity. However, the magnetic head made from the ferrite material has high distortion owing to a low saturation flux density, particularly when a metal powder tape with high coercive force is used as a magnetic recording medium. Furthermore, it generally has much noise peculiar to the ferrite material. On the other hand, the alloy material has high saturation flux density, and thus the magnetic head made from it has low distortion and low noise, but the high frequency characteristics are not preferable.

Several years ago, amorphous alloy as a new material satisfying the requirements for the magnetic head core for high density magnetic recording and reproducing system was found and regarded as promising. Metal takes a crystal form in the ordinary solid state, where the constituent atoms are regularly arranged, but under specific conditions the atoms are in a randomly arranged state similar to a liquid state. The metal under the specific conditions is called amorphous metal in contrast to the ordinary crystalline metal. The amorphous metal consisting of appropriate components in an appropriate composition has such a special structure that it has peculiar properties different from those of crystalline alloy and may show high hardness, high tensile strength, high corrosion resistivity, soft magnetic properties, etc. It is readily expectable that a magnetic head with good performance can be obtained by utilizing these characteristics of the amorphous alloy.

However, there has been no actual case of producing and selling a magnetic head with a core of amorphous alloy in a commercial scale. Since the amorphous alloy is in a non-equilibrium phase, its distinguished characteristics are liable to change, and it is difficult to produce products stable against the prolonged use. This is one of the greatest reasons. Actually it has been found that, when a magnetic head was made from the well known amorphous alloy, its characteristics were changed within a few months even at room temperature.

Furthermore, the amorphous alloy is distinguished in some characteristics, and is not always distinguished in other characteristics. Thus, it has not been a distinguished material for magnetic head core from the overall point of view.

The following references are cited to show the state of art; (i) Japanese Laid-open Patent Application No. 65395/76, (ii) Japanese Laid-open Patent Application No. 77899/76 and (iii) Japanese Laid-open Patent Application No. 105525/77.

SUMMARY OF THE INVENTION

An object of the present invention is to provide an amorphous alloy having distinguished characteristics for a magnetic head core free from the problems of the amorphous alloy according to the above-mentioned state of art, and also to provide an amorphous alloy with high permeability (particularly high permeability at high frequency), high saturation flux density, low magnetostriction and low magnetic after-effect.

The present amorphous alloy for magnetic head core for attaining the above-mentioned object is represented by the following general formula:

$$(Fe_xCo_{1-x})_aCr_bSi_cB_{1-a-b-c}$$

wherein the value of x is in a range of 0.04–0.07, the value of a in a range of 0.73–0.75, the value of b in a range of 0.005–0.03, and the value of c in a range of 0.02–0.06. Preferable ranges for the values of x and b are 0.048–0.065 and 0.01–0.025, respectively. More preferable range for the value of x and the value of b are 0.052–0.061 and 0.02, respectively.

In the case of an amorphous alloy outside the range for the value of x, the permeability of the amorphous alloy becomes considerably lower, when a magnetic head core is prepared by laminating thin amorphous alloy plates one upon another by means of an adhesive. When the value of a exceeds 0.75, the permeability of the material will be less than about 5,000 at 20 kHz, whereas when the value of a is less than 0.73, the saturation flux density will be less than about 8 kG. The characteristics are thus not sufficient for the magnetic head core outside the range for the value of a. The element Cr is effective for reducing the change in permeability of the material due to low temperature aging, but no substantial improvement in the change in permeability can be observed when the value of b is less than 0.005, whereas, if the value of b exceeds 0.03, the change in permeability due to low temperature aging is rather increased. Thus, the value of b outside the range is not preferable. Si is the necessary element for easily making the material amorphous, but the effect is not good, if the value of c is less than 0.02, whereas the change in permeability due to low temperature aging is increased if the value of c exceeds 0.06. The value of c outside the range is not preferable.

The heat-treatment at about 450°–500° C. for about 3–60 minutes can be taken for increasing the permeability of the amorphous alloy of the present invention. The heat treatment at a higher temperature than 500° C. or for more than 60 minutes makes the permeability impreferably lower thereby. The heat treatment at a lower temperature than 450° C. or for less than 3 minutes does not sufficiently improve the residual stress in the material, and the permeability is not thoroughly increased.

The optimum conditions for the heat treatment depend upon the composition of the material, and it is desirable to determine the conditions within the above-mentioned ranges by conducting a simple test.

The cooling speed of the material after the heat treatment is desirably as high as possible, and must be at least about 20° C./sec. If the cooling speed is less than 20° C./sec., the permeability of the material will be unpreferably less than about 5,000 at 20 kHz. There is no upper limit to the cooling rate, but the upper limit will be restricted by the apparatus and conditions for annealing the material.

After the heat treatment, the material, which is cooled to room temperature, can be used as such, but in order to reduce the change in permeability due to low temperature aging, the material may be aged in advance at a higher temperature than the application temperature. The aging temperature is 80°–450° C., and generally 80°–200° C. is sufficient. An aging time of more than 20 minutes is required for obtaining a sufficient aging effect. There is no upper limit to the aging time, but the aging for too long time is not economical.

The aging treatment can be carried out in the process for producing a magnetic head, for example in a core molding process.

DETAILED DESCRIPTION OF THE INVENTION

The present invention will be described in detail on the basis of data.

To obtain the following data, a method for producing an amorphous alloy sample, which is known as "simple roller type quenching method or a single rollers method" was used, where molten alloy was injected onto a metallic roller revolving at a high speed to solidify and quench the molten alloy. As other methods for producing amorphous alloy, a centrifugal method, a twin roller's method, a sputtering method, etc. are well known, and have proper characteristics, respectively, but the single roller type quenching method is regarded as most appropriate for a commercial method. Any method can be of course employed for producing amorphous alloy in the present invention, irrespectively of the above-mentioned methods.

As magnetic characteristics of magnetic head material, (1) high permeability and (2) high saturation flux density must be satisfied. However, in order to increase the permeability of samples, it is necessary to heat-treat the samples under appropriate conditions, as is generally known as the properties of amorphous ferromagnetic alloy, and if the conditions are not appropriate, the permeability will be lowered to the contrary. The heat-treating conditions also depend upon alloy composition, and there may be a case where there are no appropriate conditions according to some composition. The saturation flux density depends upon alloy composition. Thus, it is known that the amorphous alloy can be obtained in a very broad composition range, but all of these amorphous alloys are not practically used for the magnetic head core, and the amorphous alloys having satisfactory characteristics for the magnetic head core have very restricted compositions.

Figure 1:
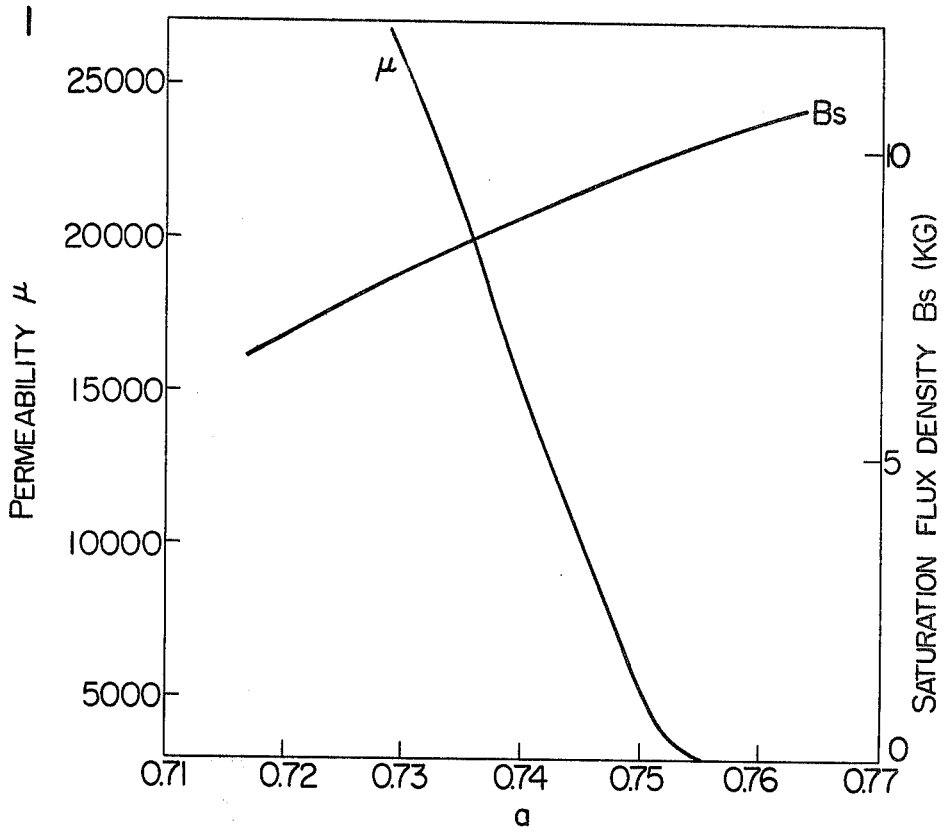
FIG. 1 is a diagram showing relationship between the saturation flux density, the permeability at a frequency of 20 kHz and the value of a of the general formula in an alloy system $(Fe_{0.06}Co_{0.94})_aCr_{0.005}Si_{0.03}B_{0.965-a}$.

In FIG. 1, dependency of permeability $\mu$ at the frequency of 20 kHz and saturation flux density upon a in an alloy system $(Fe_{0.06}Co_{0.94})_aCr_{0.005}Si_{0.03}B_{0.965-a}$ is shown, where the abscissa shows a, the amount of $(Fe_{0.06}Co_{0.94})$, and the ordinate shows $B_s$ or $\mu$. The value of $\mu$ is the highest ones of materials of individual compositions obtainable under various heat-treating conditions.

In the alloy having a composition of $a>0.75$, $\mu$ obtainable by the heat treatment is not more than 5,000, and the preferable permeability for a magnetic audio head in the application frequency range is generally 6,000 or more. Thus, the alloy having a composition of $a>0.75$ cannot be used as the magnetic head. $B_s$ decreases with decreasing a, and will be less than about 8 kgG in the alloy having a composition of $a<0.73$. Preferable saturation flux density of core material for a magnetic head for high density recording using a metal powder tape is generally 8 kG or higher, and thus the alloy having a composition of $a<0.73$ is not desirable as the magnetic head core. Thus, in the present amorphous alloy, the value of a is restricted to 0.73–0.75.

Figure 2:
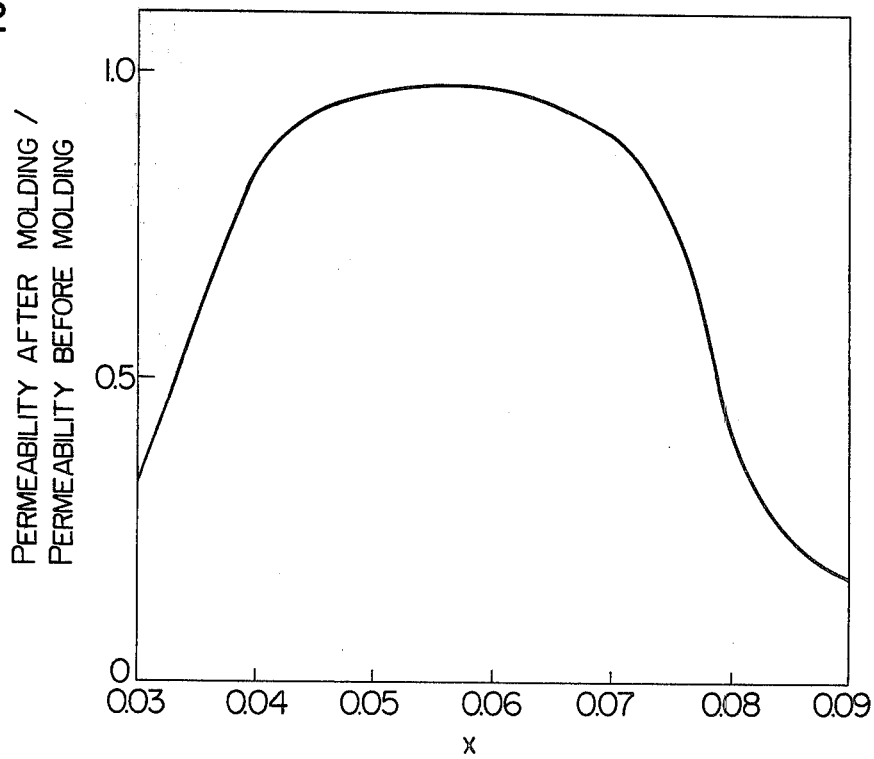
FIG. 2 is a diagram showing relationship between changes in permeability by resin molding and the value of x of the general formula in an alloy system $(Fe_xCo_{1-x})_{0.74}Cr_{0.005}Si_{0.04}B_{0.215}$.

In FIG. 2, relationship between change in permeability by resin molding and x in an alloy system $(Fe_xCo_{1-x})_{0.74}Cr_{0.005}Si_{0.04}B_{0.215}$ is shown. In order to make a plate material such as amorphous alloy into magnetic heads, it is necessary to laminate the sample by means of an adhesive such as resin, but in the case of a material having a high magnetostriction, the permeability of the material is generally lowered after such a lamination process. However, in the case of the present amorphous alloy, such trouble can be much avoided by carefully selecting x, the amount of Fe.

The data shown in FIG. 2 were obtained in the following manner:

Amorphous alloy plate, about 20 $\mu$m thick, of the above-mentioned composition was made into ring form, 3 mm in inner diameter and 5 mm in outer diameter, by mechanically punching, and the ring plates were heat-treated at 480° C. for 10 minutes and then cooled in water. Then, 20 plates were laminated, then provided with 29 turns of coil, and subjected to permeability measurement, as it is, to obtain the permeability before molding. Then, the sample with the coil was immersed in an epoxy resin containing Epikote 828 (trademark of Shell Epoxy Co., Ltd. USA) as the main component in a cylindrical vessel, 30 mm in diameter, subjected to outgassing in vacuum, then heated at 80° C. for 3 hours, left standing at room temperature for at least 24 hours, and subjected to permeability measurement of the sample after the curing of the resin to obtain the permeability after molding. The change in permeability by the resin is represented by permeability after molding-/permeability before molding. The epoxy resin containing Epikote 828 as the main component is usually used to evaluate the resin molding characteristics of permalloy foil.

As is evident from FIG. 2, x, i.e. the amount of Fe, must be adjusted to such a very narrow range as 0.04–0.07 to obtain the permeability with a small change between before and after the resin molding, because the amorphous alloy of the composition in such a range has a particularly low magnetostriction.

Si has an effect upon easy realization of an amorphous state, but a larger amount of Si element increases a magnetic after-effect, and thus is not desirable. It is very difficult to make a material containing no Si element at all, for example, $(Fe_{0.06}Co_{0.94})_{0.75}Cr_{0.005}B_{0.245}$ amorphous, but the addition of 2–16% by atom of Si element (that is, c=0.02–0.16) can make the sample easily amorphous.

Figure 3:
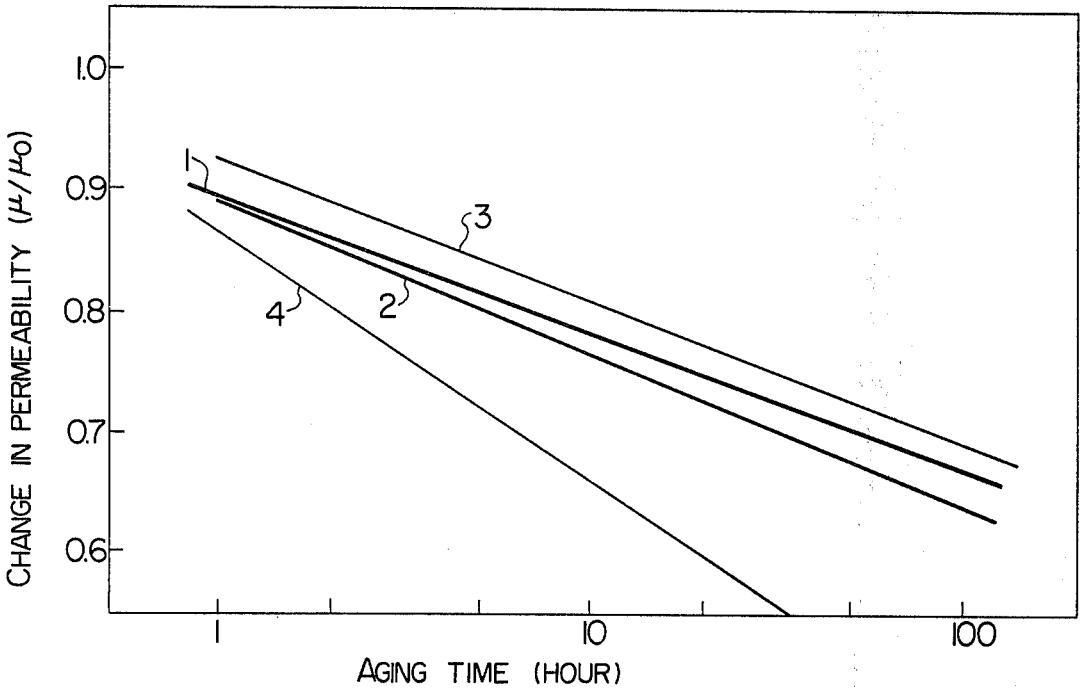
FIG. 3 is a diagram showing relationship between changes in permeability and aging time at 100° C. in amorphous alloys.

FIG. 3 shows relationship between aging time and changes in permeability at 20 kHz, where the present amorphous alloy is heated at 480° C. for 5–10 minutes, then cooled in water to obtain a permeability of 15,000 at 20 kHz, and aged at 100° C. The charge in permeability is represented by ratio $\mu/\mu_o$, where $\mu$ is the permeability after aging and $\mu_o$ is the permeability before aging (in this case $\mu_o$ is 15,000). That is, FIG. 3 is a diagram showing the change in permeablity due to low temperature aging at 100° C. of the present amorphous alloy. The change in permeability due to low temperature aging is the largest at the initial permeability, and thus was measured within the range of initial permeability by making the measuring field as low as about 0.2 mOe. The measurement was also made without A.C. demagnetization.

In FIG. 3, curve 1 corresponds to $(Fe_{0.06}Co_{0.94})_{0.74}Cr_{0.005}Si_{0.04}B_{0.215}$, curve 2 $(Fe_{0.06}Co_{0.94})_{0.745}Cr_{0.005}Si_{0.055}B_{0.195}$, and curve 3 $(Fe_{0.06}Co_{0.94})_{0.735}Cr_{0.005}Si_{0.025}B_{0.235}$, but curve 4 shows a reference case $(Fe_{0.06}Co_{0.94})_{0.745}Si_{0.135}B_{0.12}$, which is different from the compositions of the present invention. In order to reduce the change in permeability due to low temperature aging, the value of c, i.e. the amount of Si must be not more than about 0.06. When the value of c is less than 0.02, it is difficult to make the material amorphous, and this is not preferable.

Figure 4:
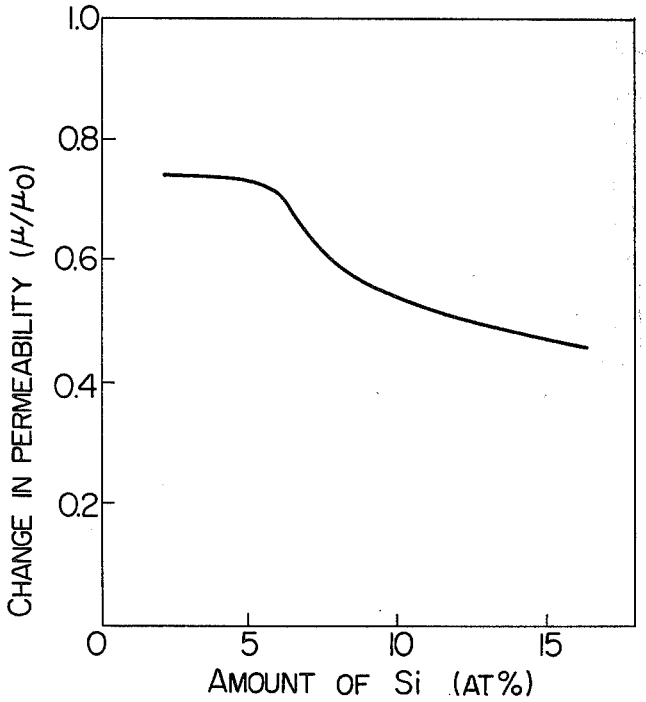
FIG. 4 is a diagram showing relationship between changes in permeability and the amount of Si after aging for 20 hours at 100° C. in an alloy system $(Fe_{0.06}Co_{0.94})_{0.74}Cr_{0.005}Si_xB_{0.255-x}$.

In FIG. 4, relationship between $\mu/\mu_o$ and the amount of Si is shown, where the amorphous alloy of composition $(Fe_{0.06}Co_{0.94})_{0.74}Cr_{0.005}Si_xB_{0.255-x}$, heat-treated to obtain a permeability of 15,000 at 20 kHz was aged at 100° C. for 20 hours. As is evident from FIG. 4, $\mu/\mu_o$ is sharply lowered when the amount of Si exceeds 6% by atom (that is, when the value of c, i.e. the amount of Si, exceeds 0.06), and the change in permeability due to low temperature aging is increased.

Cr is effective for reducing the change in permeability due to low temperature aging, and the desirable amount of Cr is 0.5–3% by atom. That is, the value of b, i.e. the amount of Cr, is desirably 0.005–0.03. The value of b of less than 0.005 is not effective for improving the change in permeability, whereas the value of b of more than 0.03 rather increases the change in permeability.

Figure 5:
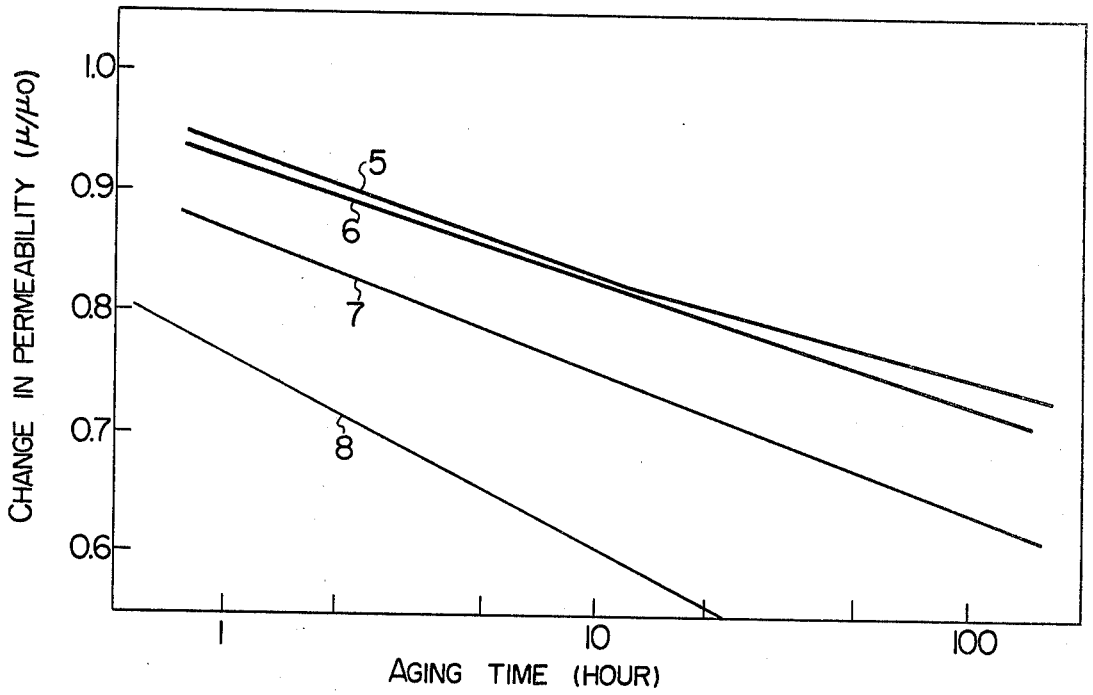
FIG. 5 is a diagram showing relationship between changes in permeability and aging time at 100° C. in an amorphous alloy.

FIG. 5 is a diagram showing changes in permeability due to low temperature aging at 20 kHz and 100° C. of the present amorphous alloy heat-treated to obtain a permeability of 15,000 at 20 kHz, where the test conditions were the same as in FIG. 3 except that the compositions of samples are different from those shown in FIG. 3. In FIG. 5, curve 5 corresponds to $(Fe_{0.06}Co_{0.94})_{0.735}Cr_{0.02}Si_{0.025}B_{0.22}$, curve 6 $(Fe_{0.06}Co_{0.94})_{0.74}Cr_{0.02}Si_{0.045}B_{0.195}$, curves 7 and 8 reference samples having different compositions from those of the present invention, curve 7 $(Fe_{0.06}Co_{0.94})_{0.74}Si_{0.04}B_{0.22}$, and curve 8 $(Fe_{0.06}Co_{0.94})_{0.73}Cr_{0.04}Si_{0.03}B_{0.20}$. As is evident from FIG. 5, changes in permeability due to low temperature aging is large when no Cr is added, and when the amount of Cr exceeds 3% by atom. (4% by atom in FIG. 5).

Since the amorphous magnetic material of the prior art, even though the magnetic after-effect is low, generally has a ratio $\mu/\mu_o$ of about 0.6 when aged at 100° C. for 20 hours, it is seen that the magnetic after-effect of the present amorphous alloys shown by curves 1, 2 and 3 of FIG. 3 and by curves 5 and 6 of FIG. 5 is considerably improved.

Thus, addition of an appropriate amount of Cr is important for lowering the magnetic after-effect, and also effective for improving corrosion resistivity and wear resistivity of the alloy.

B plays an important role in making the alloy amorphous, and the presence of about 20% by atom is necessary. In the present amorphous alloy, the amount of B is represented by 1-a-b-c, and the value of 1-a-b-c is in the range of 0.16 to 0.245 from the lower limit values and the upper limit values a, b and c. The amount of B in the above-mentioned range is enough for making the present alloy amorphous.

As described above, the present amorphous alloy has a composition $(Fe_xCo_{1-x})_aCr_bSi_cB_{1-a-b-c}$, and the alloys, where x=0.04–0.07, a=0.73–0.75, b=0.005–0.03, and c=0.02–0.06, have higher permeability and saturation flux density than the conventional ordinary amorphous alloys, and are more readily made amorphous and have small change in permeability due to low temperature aging.

When compared with the conventional magnetic head material, the present amorphous alloys are wholly distinguished, and are excellent as a material for magnetic head for high density magnetic recording and reproducing system, as shown in Table 1.

The characteristic values shown in Table 1 are approximate values, and the characteristics of sen-alloy relate to bulky material as the sample, and when the sen-alloy is made into a thin plate as thick as about a few 10 μm, the permeability at 5 MHz will be increased to the level of Mn-Zn ferrite. However, the sen-alloy is so brittle that it is difficult at least in a commercial scale to make it into a thin plate.

TABLE 1

| Material | Saturation flux density (kG) | Permeability 20 KHz | Permeability 5 MHz | Specific resistance ($\mu\Omega$cm) | Vickers hardness (Kg/mm$^2$) | Magneto-striction |
|---|---|---|---|---|---|---|
| Present invention | 8–10 | 6000–30000 | About 500 | About 120 | About 900 | $<1 \times 10^{-5}$ |
| Mn—Zn ferrite | About 5 | About 5000 | 500–700 | About $10^5$ | About 600 | About $5 \times 10^{-6}$ |
| Sen-alloy | 8–10 | About 1600 | About 40 | About 80 | About 500 | About 0 |

The magnetic characteristics of the present alloy also greatly depend upon the heat treating conditions.

Figure 7:
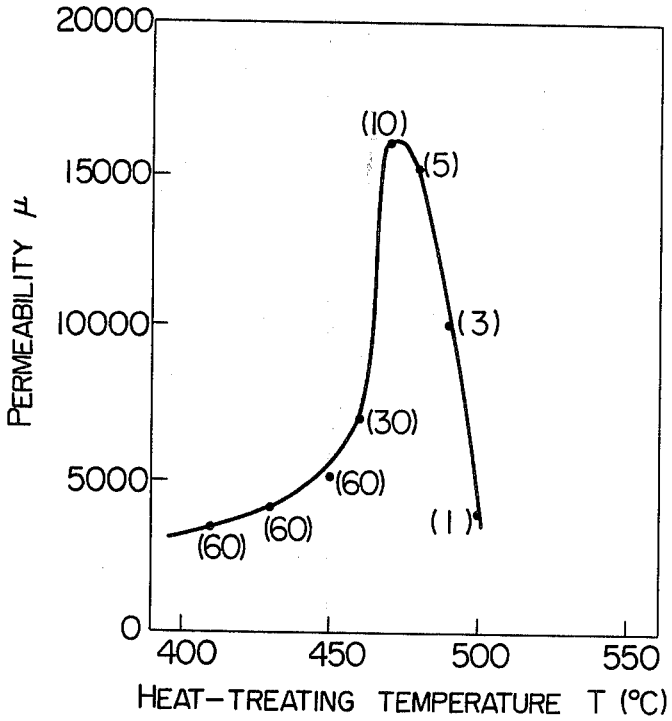
FIG. 7 is a diagram showing relationship between the permeability and the heat-treating temperature of alloy $(Fe_{0.06}Co_{0.94})_{0.74}Cr_{0.005}Si_{0.04}B_{0.215}$.
Figure 8:
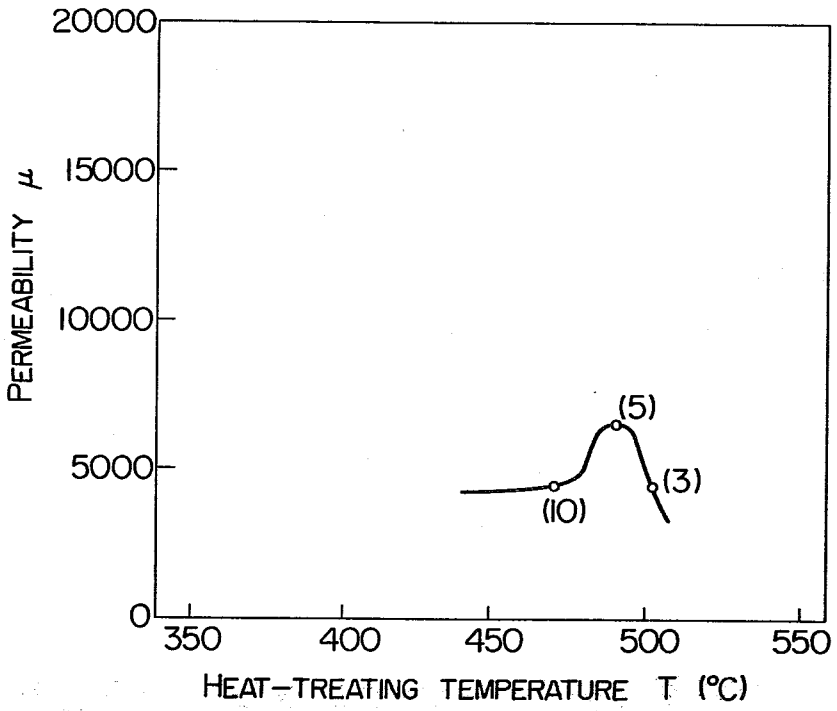
FIG. 8 is a diagram showing relationship between the permeability and the heat-treating temperature of alloy $(Fe_{0.06}Co_{0.94})_{0.75}Cr_{0.005}Si_{0.045}B_{0.20}$.
Figure 6:
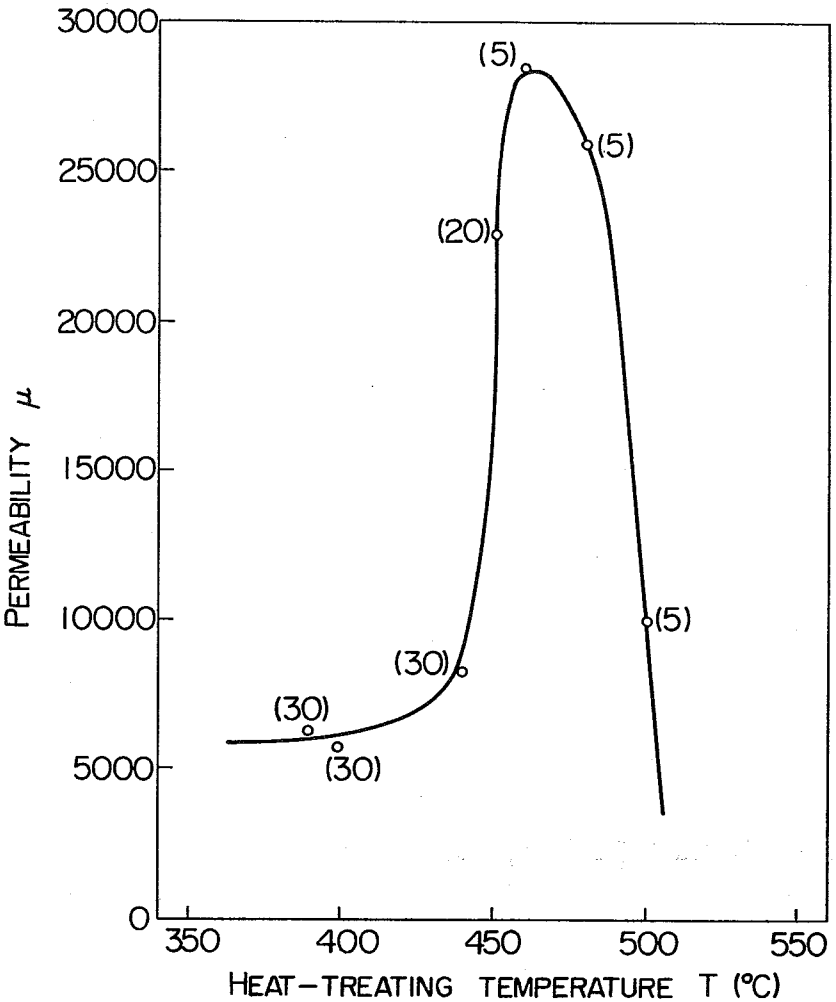
FIG. 6 is a diagram showing relationship between the permeability and the heat-treating time of alloy $(Fe_{0.06}Co_{0.94})_{0.73}Cr_{0.005}Si_{0.055}B_{0.21}$.

FIGS. 6–8 are diagrams showing relationship between the heat treating temperature and the permeability $\mu$ at the frequency of 20 kHz of the present alloy, where heat-treating time is the time for obtaining the highest permeability at a given heat-treating temperature, and is given in minutes in parenthesis in the respective diagram, and the cooling after the heat treatment is carried out by quenching in water probably at a cooling speed of about $10^{3}$° C./s, which is however impossible to measure.

FIG. 6 corresponds to $(Fe_{0.06}Co_{0.94})_{0.73}Cr_{0.005}Si_{0.055}B_{0.21}$, FIG. 7 $(Fe_{0.06}Co_{0.94})_{0.74}Cr_{0.005}Si_{0.04}B_{0.215}$, and FIG. 8 $(Fe_{0.06}Co_{0.94})_{0.75}Cr_{0.005}Si_{0.045}B_{0.20}$.

The heat-treating conditions effective for improving the permeability are the temperature of 450°–500° C. and the time of about 3–about 60 minutes, though dependent upon the alloy composition. Under the conditions for the temperature and the time above the above-mentioned ranges, the material is liable to undergo crystallization, and the permeability will be lowered to the contrary, whereas under the conditions below the above-mentioned range, the residual stress in the sample is not sufficiently improved, and thus the characteristic is not improved.

The optimum heat-treating temperature in the alloys of the respective compositions somewhat depend upon the compositions of the alloys, and that for FIG. 6 is about 460° C., that for FIG. 7 about 470° C., and that for FIG. 8 about 470° C. Thus, the optimum heat-treating temperature of alloys must be determined from a diagram similar to those of FIGS. 6–8 upon its preparation. The desirable heat-treating time at the optimum heat-treating temperature is 5–20 minutes, as evident from the data of FIGS. 6–8.

When the sample is cooled at a speed as high as possible after the heat treatment, higher permeability can be obtained.

Figure 9:
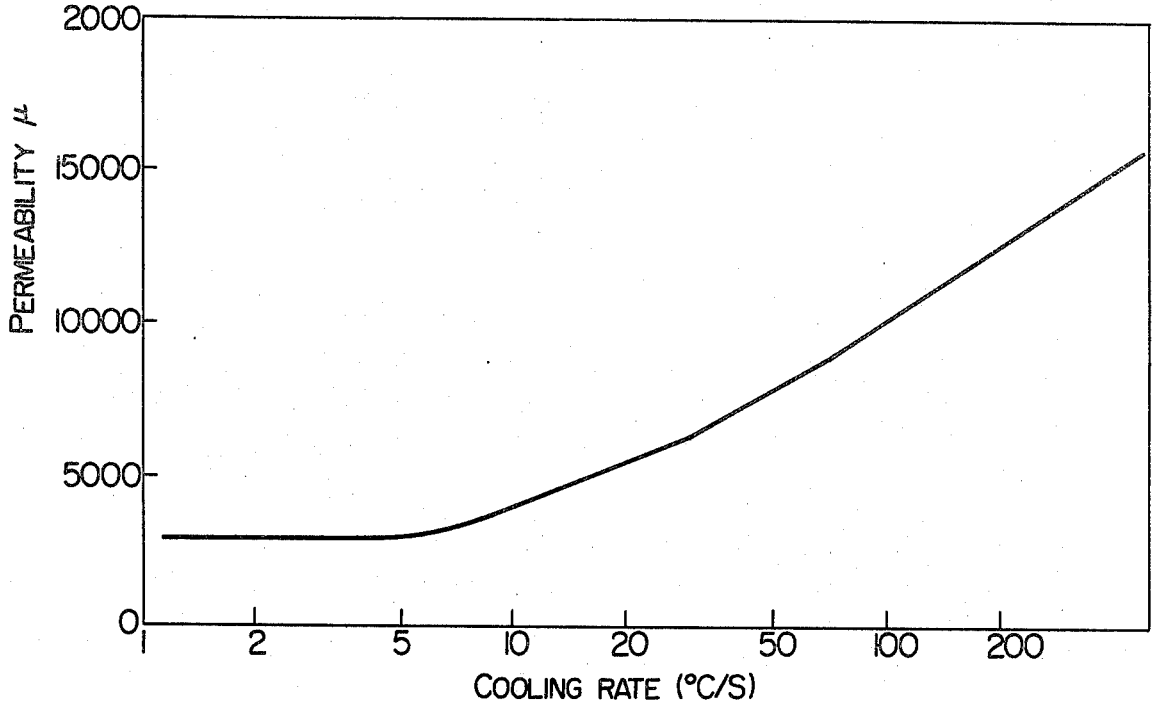
FIG. 9 is a diagram showing relationship between the permeability and the cooling rate after heat treatment of alloy $(Fe_{0.06}Co_{0.94})_{0.74}Cr_{0.005}Si_{0.04}B_{0.215}$.

FIG. 9 is a diagram showing relationship between the cooling speed (°C./s) and the permeability $\mu$ at the frequency of 20 kHz of the present alloy $(Fe_{0.06}Co_{0.94})_{0.74}Cr_{0.005}Si_{0.04}B_{0.215}$ after the heat treatment at 470° C. for 10 minutes. To make $\mu \leqq 6{,}000$ requires $R \leqq 30$° C./s, and to make $\mu \leqq 5{,}000$ requires $R \leqq 20$° C./s.

The higher the cooling speed R, the higher the permeability $\mu$. The higher the cooling speed R, the larger also the change in permeability $\mu$ due to low temperature aging. The lower R, the lower $\mu$, and the smaller the change in $\mu$. Thus, it is practically necessary to determine the cooling speed in view of the initial value of $\mu$ and the degree of the change in $\mu$ thereafter. In the most cases, it is generally appropriate that R=about 50°–about 200° C./s.

DESCRIPTION OF THE PREFERRED EMBODIMENTS

EXAMPLE 1

Molten alloy having a specific composition was injected onto a roll made of copper, 300 mm in diameter, rotating at 2,200 rpm, and solidified and quenched to prepare an amorphous alloy plate, about 20 $\mu$m thick. The amorphous alloy plate was made into a desired shape by cutting or punching, heated at 480°–500° C. for 5–10 minutes (Sample No. 2 shown in Table 2 was heated at 500° C. for 5 minutes, and others at 480° C. for 10 minutes), and cooled in water to prepare a sample. For each sample of specific composition, crystallization point Ta, Curie point Tc, saturation flux density $B_s$, permeability at 20 kHz $\mu$20K, permeability at 5 MHz $\mu_{5M}$, ratio $\mu/\mu_o$ of $\mu_{20K}$ between before and after aging at 100° C. for 20 hours, and Vickers hardness Hv were measured. The results of measurement are shown in Table 2. The compositions of the samples are given by $x$, $a$, $b$ and $c$ in the general formula $(Fe_xCo_{1-x})_aCr_bSi_cB_{1-a-b-c}$. The resistivity and magnetostriction at room temperature were measured, and were found within the range of 120–140 $\mu\Omega$cm. and less than $1\times10^{-6}$, respectively, in all the samples. In the measurement of the ratio $\mu/\mu_o$, the permeability $\mu_o$ at 20 kHz before the aging was made 15,000 in all the samples by the heat treatment.

TABLE 2

| Sample No. | Composition x | a | b | c | Ta (°C.) | Tc (°C.) | $B_s$ (kG) | $\mu_{20K}$ | $\mu_{5M}$ | $\mu/\mu_o$ | Hv (Kg/mm$^2$) |
|---|---|---|---|---|---|---|---|---|---|---|---|
| 1 | 0.06 | 0.74 | 0.005 | 0.035 | 526 | 470 | 9.2 | about 20000 | 400 | 0.75 | 890 |
| 2 | 0.06 | 0.75 | 0.005 | 0.035 | 513 | 515 | 9.6 | about 6000 | 350 | — | 900 |
| 3 | 0.06 | 0.735 | 0.02 | 0.025 | 528 | 482 | 8.5 | about 16000 | 360 | 0.8 | 850 |
| 4 | 0.06 | 0.74 | 0.02 | 0.045 | 517 | 479 | 8.5 | about 16000 | 370 | 0.8 | 900 |

As is evident from the data given in Table 2, the present amorphous alloys satisfy the requirements for magnetic head core, i.e. saturation flux density, permeability at every frequency and magnetostriction, and the change in permeability due to low temperature aging is considerably lower than that of the conventional amorphous alloy.

substantially same shape and being made from bulky sen-alloy are given for comparison:

TABLE 3

| Material | Gap length (μm) | Optimum bias current (μA) | Maximum outlet level 1 kHz | Maximum outlet level 10 kHz | Distortion factor (at 1 kHz) | Reproducing sensibility (at 1 kHz) | Frequency response 14 kHz/1 kHz |
|---|---|---|---|---|---|---|---|
| Present invention | 1.5 | 300 | $6.5^{dB}$ | $-1^{dB}$ | $-40^{dB}$ | $-69^{dB}$ | $-0.5^{dB}$ |
| Sen-alloy | 1 | 1500 | 7 | −3 | −36.5 | −69 | −1 |

EXAMPLE 2

Amorphous alloy plates having the same compositions as in Table 2 (20 μm thick, 20 mm wide and 10 m long) were prepared in the same manner as in Example 1. The magnetic characteristics were substantially equal to those of Example 1. In the present Example, audio read-write heads were prepared from the amorphous alloy plates.

Figure 10:
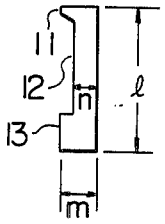
FIG. 10 is a plan view of core plate consisting of the amorphous alloy according to one embodiment of the present invention.

The amorphous alloy plates were made into core plates of shape as shown in FIG. 10 by mechanical punching with a cemented carbide die. In FIG. 10, dimensions l, m, and n are 11 mm, 2.5 mm and 2 mm, respectively.

Figure 11:
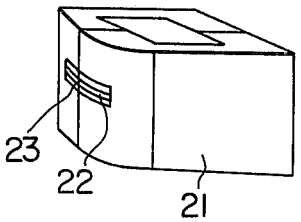
FIG. 11 is a schematic view of magnetic head according to one embodiment of the present invention.

The punched-out core plates were heated at 470° C. for 10 minutes, and then cooled in water. 30 core plates thus heat treated were laminated and bonded to one another with an epoxy adhesive containing Epikote 828 as the main component (overall thickness was 0.6 mm) to make a core-half with a track width of 0.6 mm (the overall thickness of laminate is equal to the track width). For bonding, the core-half was heated at 80°–130° C. for 1–5 hours. Two core-halves thus prepared were jointed together so that surface 11 and surface 13 could be bonded to the corresponding surfaces, respectively. The surfaces 11 served as a gap when a head was prepared, and a gap spacer having a specific thickness and being made from a Cu-Be alloy foil was provided between the surfaces 11 (Ti, $SiO_2$, etc. can be also used as the spacer beside Cu-Be) to form a gap having a gap length of 1.5 μm. The surfaces 13 served as contact surfaces against the head surface in contact with a tape and the gap surface. 700 turns of coil was provided at window 12 of the magnetic head core thus prepared. Then, the entirety was molded with a polymer resin having a lower curing temperature than that used for lamination, i.e. the epoxy resin containing Epikote 828 as the main component and having a curing temperature lowered by changing a mixing ratio of curing agent, etc., and then the surface in contact with the tape was polished to form a magnetic head shown in FIG. 11. In FIG. 11, numeral 21 is polymer resin, 22 a core consisting of amorphous alloy laminate, and 23 a gap. The present magnetic head had a track width of about 0.6 mm, a gap length of 1.5 μm and a gap depth of about 100 μm. It is not always necessary to mold the entirety with the polymer resin, but to mold only the coil and its surroundings. Mechanical fixing, for example, by screwing, can be also used in place of the fixing by the resin.

Main characteristics of the present magnetic head were measured with a metal powder tape with a high coercive force of 1,050 Oe. Results of measurement are shown in Table 3, where the frequency of A.C. bias used was 105 kHz. In Table 3, the results of measurement of the conventional magnetic head having the As is evident from Table 3, characteristics of the magnetic head using the core made from the present amorphous alloy are better than those using the core made from the conventional sen-alloy. Particularly, the characteristics at a high frequency and distortion factor are excellent. When the frequency of A.C. bias at the recording is changed to 105 kHz as so far usually used, the optimum bias current is about 300 μA, which is smaller and has more allowance than in the case of the ordinary magnetic head. It is also possible to select a higher frequency of the bias, and an improvement of the characteristics thereby is expectable.

EXAMPLE 3

Figure 12:
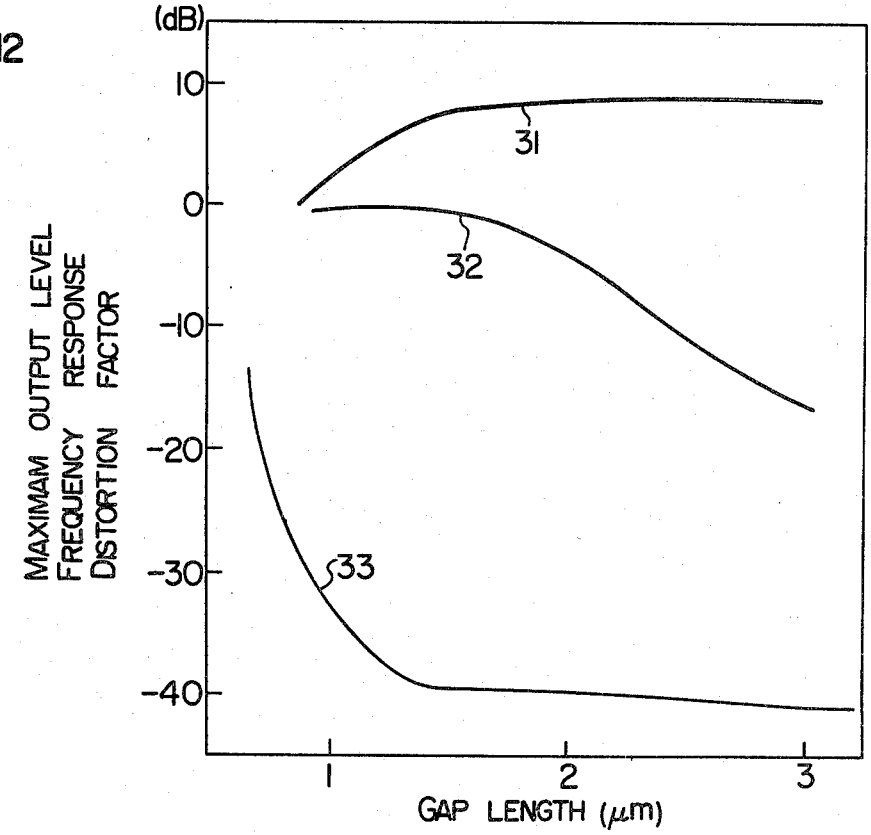
FIG. 12 is a diagram showing relationship between magnetic head characteristics and gap length according to another embodiment of the present invention.

Magnetic heads with core of amorphous alloy were prepared in the same manner as in Example 2, except that the gap length was changed to various values within the range of 0.7–3 μm, and their characteristics were measured in the same manner as in Example 2. FIG. 12 is a diagram showing relationship between the gap length and magnetic head characteristics, where curve 31 shows the maximum output level at 1 kHz, curve 32 the frequency response (14 kHz/1 kHz, i.e. a ratio of the reproducing sensibility at 14 kHz to that at 1 kHz), and curve 33 the distortion factor at 1 kHz.

According to the overall characteristics of recording and reproducing shown in FIG. 12, the recording characteristics are abruptly deteriorated, when the gap length is less than about 1.2 μm, and the recording characteristics are deteriorated when the gap length is more than about 2 μm. Thus, when an audio read-write magnetic head is prepared from the present amorphous alloy, it is necessary to select the gap length of 1.2–2 μm.

The magnetic head with the present amorphous alloy described in the foregoing Examples 2 and 3 have not been susceptible to any change in the characteristics as the magnetic head at a temperature of 80° C. for 3 months, and thus the change in characteristics as the magnetic head has no substantially practical problem, so long as the change in permeability due to low temperature aging can be suppressed as in the present amorphous alloy.

The foregoing Examples are restricted to the application to audio heads, but the present amorphous alloy is also applicable to video heads. In the latter case, the change in permeability of the present amorphous alloy due to low temperature aging is very small at a frequency of 200 kHz or higher, and thus the difficulty due to the magnetic after-effect can be completely removed. In the case of video head, it is preferable to select a gap length of 0.2–0.7 μm.

As described above, the present invention provides amorphous alloy practically applicable to a magnetic head by making the composition of amorphous alloy suitable particularly to a magnetic head core material, thereby improving the overall characteristics, considerably reducing the magnetic after-effect, and further setting the appropriate heat-treating conditions for the alloy, and also the present invention discloses use of an appropriate magnetic head structure for application of the amorphous alloy as core, making it possible to produce a magnetic head with high performance utilizing the characteristics of amorphous alloy for the first time.

Since numerous changes and different embodiments of the invention may be made without departing from the spirit and scope thereof, it is intended that all matter contained in the description shall be interpreted as illustrative and not in limiting sense.

What is claimed is:

1. Amorphous alloy for magnetic head core, represented by the general formula:

$$(Fe_xCo_{1-x})_aCr_bSi_cB_{1-a-b-c}$$

wherein the value of x is 0.04–0.07, the value of a is 0.73–0.75, the value of b is 0.005–0.03, and the value of c is 0.02–0.06, whereby said alloy has a saturation flux density of 8 kG or higher, permeability of more than 5000 at 20 kHz and magnetostriction of less than $10^{-6}$ such that said alloy can be utilized for magnetic head cores.

2. Amorphous alloy for magnetic head core according to claim 1, wherein the value of x is 0.048–0.065.

3. Amorphous alloy for magnetic head core according to claim 1, wherein the value of x is 0.052–0.061.

4. Amorphous alloy for magnetic head core according to claim 1, 2 or 3, wherein the value of b is 0.01–0.025.

5. Amorphous alloy for magnetic head core according to claim 1, 2 or 3, wherein the value of b is about 0.02.

6. Amorphous alloy for magnetic head core according to claim 1, wherein the amorphous alloy has been heated at 450°–500° C. for 3–60 minutes and then cooled at a cooling speed of at least 20° C./sec, whereby said amorphous alloy has an increased permeability.

* * * * *